US007096939B2

(12) United States Patent
Kirk et al.

(10) Patent No.: US 7,096,939 B2
(45) Date of Patent: Aug. 29, 2006

(54) SLOTTED EXPANDABLE CENTRALISER

(75) Inventors: Ian Alastair Kirk, Aberdeen (GB); William Barron, Aberdeen (GB); Alistair Bertram Clark, Aberdeen (GB)

(73) Assignee: Downhole Products plc, Aberdeen (GB)

( * ) Notice: Subject to any disclaimer, the term of this patent is extended or adjusted under 35 U.S.C. 154(b) by 0 days.

(21) Appl. No.: 10/507,031

(22) PCT Filed: Mar. 11, 2003

(86) PCT No.: PCT/GB03/01022

§ 371 (c)(1),
(2), (4) Date: Sep. 8, 2004

(87) PCT Pub. No.: WO03/078789

PCT Pub. Date: Sep. 25, 2003

(65) Prior Publication Data

US 2005/0150654 A1 Jul. 14, 2005

(30) Foreign Application Priority Data

Mar. 16, 2002 (GB) ..... 0206256.0

(51) Int. Cl.
*E21B 17/10* (2006.01)

(52) U.S. Cl. ..... 166/241.6; 166/206; 166/207

(58) Field of Classification Search ..... 166/206, 166/207, 217, 212, 241.6, 241
See application file for complete search history.

(56) References Cited

U.S. PATENT DOCUMENTS

| | | | | |
|---|---|---|---|---|
| 5,358,040 | A | 10/1994 | Kinley et al. | |
| 5,785,125 | A * | 7/1998 | Royer | 166/380 |
| 6,065,500 | A | 5/2000 | Metcalfe | |
| 6,098,717 | A | 8/2000 | Bailey et al. | |
| 6,662,876 | B1 * | 12/2003 | Lauritzen | 166/380 |
| 6,789,622 | B1 * | 9/2004 | Ducasse et al. | 166/277 |
| 6,896,052 | B1 * | 5/2005 | Simpson et al. | 166/207 |
| 6,899,181 | B1 * | 5/2005 | Simpson et al. | 166/380 |
| 2002/0112853 | A1 * | 8/2002 | Buytaert | 166/241.6 |
| 2004/0173349 | A1 * | 9/2004 | Pointing | 166/241.6 |

FOREIGN PATENT DOCUMENTS

| | | |
|---|---|---|
| WO | 03-006789 | 1/2003 |

* cited by examiner

*Primary Examiner*—Hoang Dang
(74) *Attorney, Agent, or Firm*—Drinker Biddle & Reath LLP

(57) ABSTRACT

This invention relates to a slotted expandable centraliser. In preferred embodiments, the centraliser is adapted to be used in conjunction with slotted casing, and can expand with the casing when an expander cone is propelled through the casing.

20 Claims, 2 Drawing Sheets

SLOTTED EXPANDABLE CENTRALISER

This Application is the U.S. National Phase Application of PCT International Application No PCT/GB03/01022 filed Mar. 11, 2003.

This Application relates to a centraliser for an oil well tubular.

DESCRIPTION OF THE RELATED ART

Expandable centralisers are known, such as the bow-spring centraliser, which employs resilient bow-springs that are biased into an expanded configuration, and forced into a narrower bore so that the springs deform between the body of the centraliser and the borehole to space the centraliser body apart from the borehole.

BRIEF SUMMART OF THE INVENTION

According to the present invention there is provided a slotted expandable centralizer.

Typically the centraliser has a body with a bore to accept a tubular, and is radially expandable to an expanded configuration on application of a force in a radial direction.

Preferably, the centraliser has blades that can project radially outward from the body of the centraliser in a non-expanded configuration.

Preferably, the blades and the centraliser are made from a metal such as steel, and can be of the same thickness.

Optionally, the blades can project outwardly from the body of the centraliser in the expanded configuration. Alternatively, the blades can change configuration during expansion of the centraliser so that the expanded configuration can have a more uniform radius.

Preferably, the centraliser has at least two slots. Preferably, the slots are longitudinal in the non-expanded configuration, and open to generally diamond-shaped apertures in the expanded configuration. Typically, slots are arranged in longitudinally aligned rows with slots in adjacent rows being axially offset with respect to one another, so that the ends of circumferentially adjacent slots overlap. The rows and the slots themselves need not be axially aligned; this is merely a preferred option.

Alternatively, the slots are C-shaped in the non-expanded configuration. Other shapes of slots are possible, such as Z-shapes.

Preferably, the slots are of uniform dimension, but this is not necessary.

Optionally, slots are uniformly distributed over the body and the blades. Alternatively, the centraliser has slotted portions circumferentially adjacent to non-slotted portions.

Optionally, the non-slotted portions include at least one blade.

Optionally, all of the blades are located in non-slotted portions.

Typically, the centraliser is made from a material which is capable of plastic and/or elastic deformation.

Typically the centraliser is adapted to receive an expandable tubular within its bore and is adapted to deform radially with the expandable tubular during expansion.

According to another aspect of the present invention, there is provided a centraliser assembly comprising a slotted expandable centraliser which has a body with a bore to accept a tubular, and is radially expandable on application of a force in a radial direction to an expanded configuration; and an expandable tubular, located in the bore of the centraliser.

The tubular can comprise production tubing, casing, liner, drill pipe, screen, perforation guns or any other kind of downhole tubular.

Preferably, the force to expand the centraliser is provided by an expander device such as an expansion cone being pushed or pulled through the tubular.

The slots can have a typical length of between 1 and 5 cm, but this is only optional, and other lengths of slot can be used.

BRIEF DESCRIPTION OF THE SEVERAL VIEWS OF THE DRAWINGS

An embodiment of the invention will now be described by way of example only and with reference to the accompanying drawings, in which.

DETAILED DESCRIPTION OF THE INVENTION

Figure 1B:
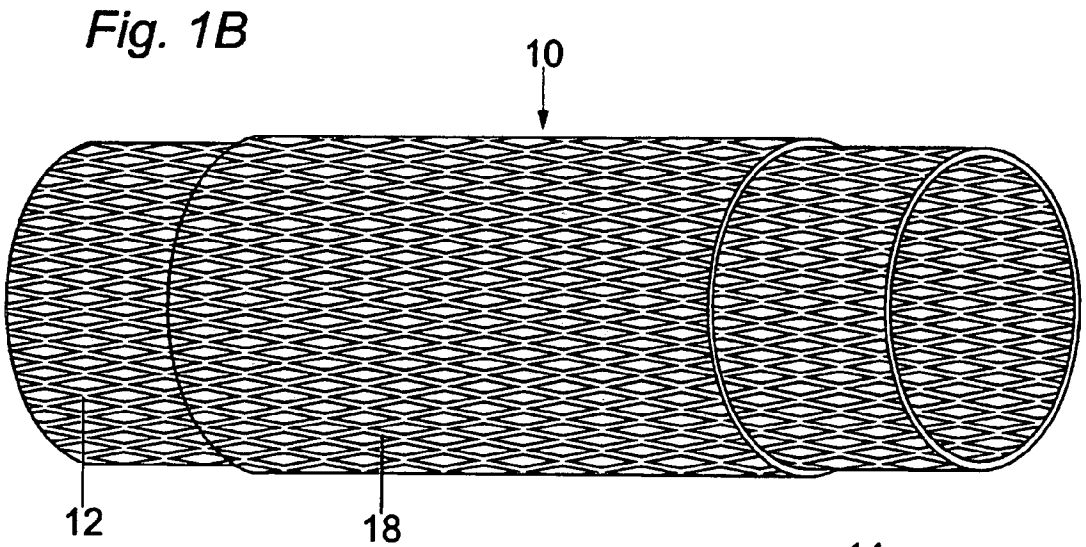
FIG. 1B shows the centraliser of FIG. 1A in an expanded configuration.
Figure 1A:
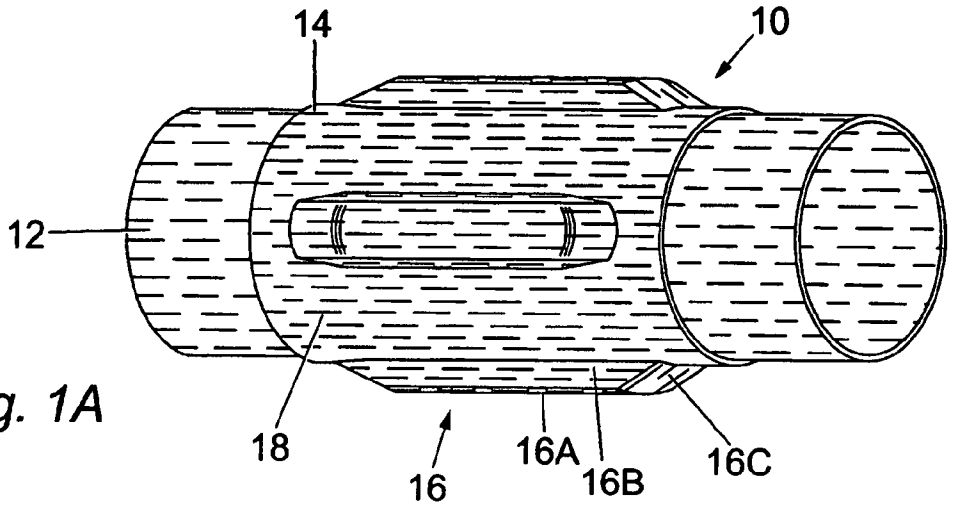
FIG. 1A shows a perspective view of a centraliser in an initial, non-expanded configuration.

Referring now to the drawings, FIG. 1A shows a steel centraliser 10 in a non-expanded configuration, attached to a slotted expandable steel tubular 12. The slotted expandable steel tubular 12 is well known in the art. Both the centraliser 10 and the tubular 12 have many slots 18, distributed approximately uniformly over the surface.

The centraliser 10 comprises a body 14 and blades 16 which project radially outwards from the body 14 in the non-expanded configuration shown in FIG. 1A. In this embodiment the blades 16 are hollow projections formed by pressing the blade shape from the body 14, and are of the same thickness and material as the body of the centraliser 10. The blades 16 each comprise an outer face 16A, side walls 16B and end walls 16C.

The slots 18 are typically between 1–5 cm in length and are arranged in parallel rows that are aligned with the axis of the tubular 12 and the centraliser 10. Slots in circumferentially adjacent rows are axially offset with respect to one another, so that the ends of the circumferentially adjacent slots overlap, leaving a web of metal between the ends of axially adjacent slots, and their circumferentially adjacent neighbours. Each slot 18 has a much shorter length than the axial length of the centraliser 10. The slots 18 cover both the body 14 and the blades 16.

All of the slots 18 may be of uniform size and shape, or alternatively, the slots on the blades 16 could be differently shaped to the slots on the body 14.

In use, an unexpanded centraliser 10 is fitted onto a string of expandable tubulars 12, with the tubular 12 received within the bore of the centraliser as shown in FIG. 1A. The string is lowered into a borehole to the depth where expansion of the tubular 12 is desired. An expander device (not shown) is then pulled or pushed through the tubular 12. A possible expander device is an expander cone, which is typically pulled/pushed by a hydraulic ram or by fluid pressure. The expander device expands the tubular 12 as it passes through it, and as the tubular expands this expands the centraliser 10 located on the outer surface of the tubular 12.

The largest end of the cone has a greater cross-sectional area than that of the non-expanded centraliser, so as the cone passes the centraliser 10, the centraliser 10 experiences a radial expansion force from the expander cone (transmitted via the expandable tubular 12). The two sides of each slot on the centraliser 10 are pushed apart from each other, which widens the slot to the extent permitted by the web of metal between adjacent slots. Thus, the slots change shape; from being long and thin, they become shorter, fatter diamond-shaped apertures. The centraliser radially expands to the size of the widest part of the expander cone. The shape of the final aperture in the expanded centraliser 10 is determined by the size, shape and strength of the web between the slots.

The blades 16 do not need to expand as much as the body 14 of the centraliser 10 in order to accommodate the expander cone, as they have already been pressed out of the body of the centraliser 10. Thus, the slots of the outer faces 16A may adopt a different shape (e.g. narrower) on expansion as compared with the slots on the body of the centraliser 10. Likewise, parts of the side walls 16B and end walls 16C need to expand more than other parts, so there can optionally be a non-uniform pattern of apertures on the expanded centraliser, which can be used to influence the shape and strength characteristics of the expanded centraliser 10. After the cone has passed the centraliser 10, the whole centraliser 10 adopts approximately the same inner diameter as the outer diameter of the tubular 12.

FIG. 1B shows the centraliser 10 of FIG. 1A in an expanded configuration. The outer faces 16A of the arms 16 have expanded less than the body of the centraliser 10, so that the expanded centraliser 10 has a generally uniform radius.

This embodiment is useful for inserting expandable tubulars such as screens into a borehole, where the blades 16 of the centraliser 10 are required to ease entry of the string into the hole but are not required after expansion of the screen against the borehole wall. With slotted blades as in this embodiment, the centraliser can ease the passage of the string into the hole, reducing friction between the screen and the hole, and spacing the screen from the wall to enhance insertion, and after expansion of the string can virtually disappear against the borehole wall.

In this embodiment the pattern of the slots on the blades and the body are substantially the same and this can give rise to a non-uniform pattern of apertures on the expanded centraliser. In other embodiments, the pattern or shape of the slots on the blades 16 can differ from the pattern or shape of the slots on the body of the centraliser 10, so as to adopt a more uniform pattern of apertures after expansion of the centraliser 10.

Figure 2B:
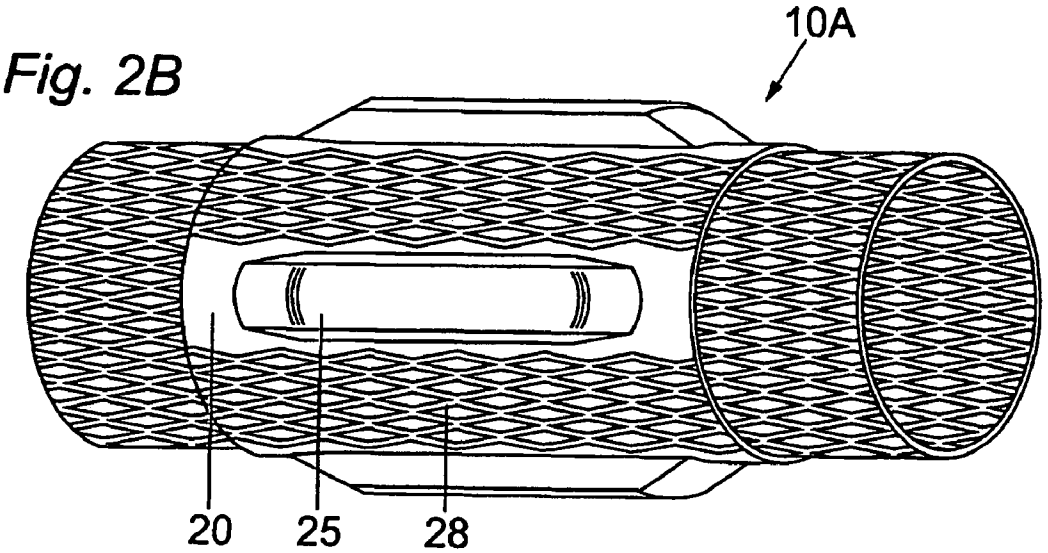
FIG. 2B shows the centraliser of FIG. 2A in an expanded configuration.
Figure 2A:
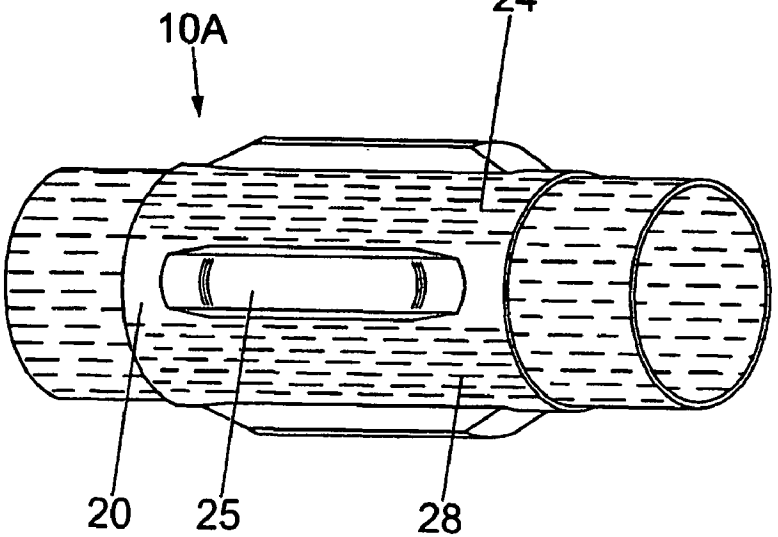
FIG. 2A shows an alternative embodiment of a centraliser in a non-expanded configuration.

FIG. 2A shows an alternative embodiment of a centraliser 10A. The centraliser 10A has a body 24 and longitudinal strips 20, which are not slotted. Blades 25 are positioned on the longitudinal non-slotted strips 20. The rest of the centraliser 10A is slotted, as in the embodiment of FIGS. 1A and 1B.

Slots 28 are aligned axially in rows, as in the embodiment of FIGS. 1A and 1B. Slots 28 in adjacent rows are axially offset with respect to one another. Each slot 28 has a much shorter length than the axial length of the centraliser 10A.

In use, the centraliser 10A is attached to a portion of slotted pipe and expanded in the same way as the centraliser 10 of FIGS. 1A and 1B, i.e. by means of an expander cone. The slotted parts of the centraliser 10A expand in the way described above: the two sides of each slot are pushed apart from each other, which widens the slot. The long thin slots become shorter, fatter diamond-shaped apertures.

The non-slotted strips 20 do not substantially expand (apart from possibly some plastic/elastic deformation). Thus, the non-slotted strips 20 do not change their shape substantially, and the blades 25 remain protruding from the expanded body 24. They may become further circumferentially spaced apart from each other, due to the expansion of the slotted parts of the body 24 between the blades 25. FIG. 2B shows the centraliser 10A of FIG. 2A in an expanded configuration.

This embodiment is suitable for expandable casing strings that still require a centraliser function after expansion, for example to provide an annulus for cement, or to wash out debris or other material from the well after insertion of the casing.

It should be noted that it is possible to provide some embodiments with intermediate properties, for example a slotted body and blades with comparatively fewer slots, so that the blades can expand less than the body, and a small blade structure is left after expansion.

Modifications and improvements can be incorporated without departing from the scope of the invention.

What is claimed is:

1. A centraliser adapted to expand radially from a non-expanded configuration to an expanded configuration, the centraliser having:

a body and at least one blade that projects radially from the body in the non-expanded configuration; and slots provided in the body of the centraliser;

wherein the slots are adapted to deform during expansion of the centraliser to the expanded configuration.

2. A centraliser as claimed in claim 1, wherein the body has a bore to accept a tubular.

3. A centraliser as claimed in claim 1, wherein the slots are longitudinal in the non-expanded configuration and diamond-shaped in the expanded configuration.

4. A centraliser as claimed in claim 2, being adapted to receive an expandable tubular and adapted to deform radially with the expandable tubular upon expansion of the tubular.

5. A centraliser as claimed in claim 1, wherein the at least one blade projects radially outward of the body in the expanded configuration.

6. A centraliser as claimed in claim 1, wherein the at least one blade is adapted to change configuration during expansion of the centraliser.

7. A centraliser as claimed in claim 1, wherein the at least one blade is adapted to retain its configuration during expansion of the centraliser.

8. A centraliser as claimed in claim 1, wherein the at least one blade has the same thickness as the body.

9. A centraliser as claimed in claim 1, having slotted portions circumferentially adjacent to non-slotted portions.

10. A centraliser as claimed in claim 9, wherein the at least one blade is located in a non-slotted portion.

11. A centraliser as claimed in claim 1, wherein the slots are uniformly distributed over the centraliser.

12. A centraliser as claimed in claim 1, wherein the slots are arranged in longitudinally aligned rows with slots in adjacent rows being axially offset with respect to one another so that the ends of circumferentially adjacent slots overlap.

13. A centraliser as claimed in claim 1, wherein the slots are of uniform dimension.

14. A centraliser as claimed in claim 1, being adapted to deform plastically.

15. A centraliser as claimed in claim 1, being adapted to deform elastically.

16. A centraliser as claimed in claim 1, being a casing centraliser.

17. A centraliser assembly comprising a centraliser as claimed in claim 1 which has a bore to accept a tubular, and an expandable tubular, located in the bore of the centraliser.

18. An assembly as claimed in claim 17, wherein the centraliser is a casing centraliser.

19. An assembly as claimed in claim 17, wherein the tubular comprises casing, liner or a screen.

20. An expandable casing centraliser having a body and an array of deformable slots in the body of the centraliser, at least one slot being axially spaced relative to another slot, the centralizer being adapted to expand from a non-expanded configuration to an expanded configuration, the centraliser comprising at least one blade that projects radially from the body in the non-expanded configuration.

* * * * *